US005422462A

United States Patent [19]

Kishimoto

[11] Patent Number: 5,422,462

[45] Date of Patent: Jun. 6, 1995

[54] ELECTRIC HEATING SHEET

[75] Inventor: Yoshio Kishimoto, Hirakata, Japan

[73] Assignee: Matsushita Electric Industrial Co., Ltd., Osaka, Japan

[21] Appl. No.: 221,501

[22] Filed: Apr. 1, 1994

[30] Foreign Application Priority Data

Apr. 12, 1993 [JP] Japan ..... 5-084392

[51] Int. Cl.[6] ..... H05B 3/34

[52] U.S. Cl. ..... 219/545; 219/529

[58] Field of Search ..... 219/545, 528, 529, 558, 219/559, 211, 212

[56] References Cited

U.S. PATENT DOCUMENTS

| | | | |
|---|---|---|---|
| 919,402 | 4/1909 | Trumpler | 219/545 |
| 2,294,010 | 8/1942 | Van Daam | 219/545 |
| 2,379,580 | 7/1945 | Hendley | 219/545 |
| 2,744,996 | 5/1956 | Clark | 219/545 |
| 2,967,415 | 1/1961 | Ford | 219/545 |
| 3,513,297 | 5/1970 | Jordan | 219/545 |
| 3,623,916 | 11/1971 | Toyooka | 219/545 |
| 3,721,799 | 3/1973 | Carlstrom | 219/545 |
| 4,503,322 | 3/1985 | Kishimoto et al. | 219/505 |
| 4,533,821 | 8/1985 | Sato | 219/545 |
| 4,538,054 | 8/1985 | de la Bretoniere | 219/545 |
| 4,603,179 | 7/1986 | Hosaka et al. | 525/429 |
| 4,617,356 | 10/1986 | Hosaka et al. | 525/429 |
| 4,698,488 | 10/1987 | Kishimoto et al. | 219/549 |
| 4,845,343 | 7/1989 | Aune | 219/545 |

FOREIGN PATENT DOCUMENTS 2-17609 1/1990 Japan .

*Primary Examiner*—Teresa J. Walberg
*Attorney, Agent, or Firm*—Fish & Richardson

[57] ABSTRACT

Conductive yarns and conductive wires having insulating properties at least on their surfaces are plain-woven as warps and wefts, thus manufacturing a unidirectionally conductive fabric in which neighboring conductive yarns are not electrically in contact with each other. A pair of electrodes is connected to ends of the conductive yarn, and polymeric insulating layers are laminated on both surfaces of the unidirectionally conductive fabric, thus manufacturing an electric heating sheet. Moreover, by forming polymeric covering layers having a thermal fuse function, a temperature-detecting function and a temperature controlling function on the unidirectionally conductive fabrics, highly durable and safe electric heating sheets are manufactured.

6 Claims, 8 Drawing Sheets

ELECTRIC HEATING SHEET

FIELD OF THE INVENTION

The invention relates to an electric heating sheet used for sheet-form electric warmers such as electric carpets, electric blankets, floor heating apparatus, panel heaters and the like.

BACKGROUND OF THE INVENTION

Flexible tube-form heating wires, etched aluminum sheet-form heaters, conductive fabrics or the like have been conventionally applied to sheet-form electric warmers such as electric carpets, electric blankets, floor heating apparatus, panel heaters and the like. As temperature sensors detecting the temperature of these electric warmers, temperature-detecting wires using thermosensitive polymeric compounds, thermal heating wires, metal resistance wires and the like have been employed.

When a thermosensitive polymeric compound, which is a high impedance material of $10^9-10^6\Omega\cdot$cm, is used for the temperature sensor, it should be used in the form of a temperature-detecting wire or an etched aluminum sheet-form heater to lower the impedance significantly. As a result, no noise malfunction is generated in the temperature sensor. The temperature-detecting wire and the thermal heating wire are electric wires having doubly wound spiral electrodes, and layers of thermosensitive polymeric compounds have a parallel structure in a wire-length direction and are lowered in impedance. The etched aluminum sheet-form heater, on the other hand, comprises a polymeric temperature-sensing layer sandwiched between two sheets of etched aluminum heaters, and the impedance of the thermosensitive polymeric layer varies with temperature.

The temperature-sensing wires using the thermosensitive polymeric compound are of two different forms, including a two-wire system consisting of the temperature-sensing wire and the heating wire, and a one-wire system in which one electrode wire in the temperature-sensing wire is used for passing electric current and generating heat.

A PTC (positive temperature coefficient) heating resistor, having a large positive temperature coefficient of resistance, constantly controls its own temperature when a constant voltage is applied to a pair of electrodes, which gives uniform temperature distribution. Therefore, the PTC heating resistor is used as a temperature self-controlling heater such as a flat cable having parallel electrode wires, a tape heater having sandwiched electrodes or a sheet-form heater formed on heat-diffusion plates.

However, the temperature uniformity of the tube-form heating wires is low since they are distributed with space in between them. In addition, the temperature of locally overheated sections of the wire becomes high. When a heating wire is broken at one location, the whole heater stops heating.

Etched aluminum sheet-form heaters, on the other hand, have uniform temperature distributions. However, the sheet-form heater is likely to be broken when it is bent.

Since conventional conductive fabrics do not have unidirectional conductivity, high voltage is likely to be applied around the broken sections, thus promoting local overheatings. As a result, conventional conductive fabrics may cause a fire.

A PTC heating resistor comprises a PTC resistance sheet with parallel electrode wires. Therefore, due to the flow of heavy electric current in the parallel electrode wires, overheating occurs by an electric arc or the like at the section of the breakage of the electrode wire. Moreover, if the PTC heating resistor is not applied on a heat-diffusion plate, high voltage is likely to be concentrated locally at the high temperature section of the PTC resistance sheet by a positive feedback. As a result, heat does not generate evenly, and the materials of the resistor deteriorate, thus causing accidents.

SUMMARY OF THE INVENTION

The first objective of the invention is to provide a significantly safe and bendable electric heating sheet by using a unidirectionally conductive sheet, thereby solving the problems of conventional electric heating sheets.

In addition to these safety and bendability characteristics, the electric heating sheet of the invention also has a thermal fuse function as a second objective.

The third objective of the invention is to provide an electric heating sheet which provides the above advantages and also has a temperature-sensing function.

The fourth objective of the invention is to provide a safe PTC resistance sheet which does not require a heat-diffusion plate and has an excellent temperature controlling function.

In order to achieve the first objective, the electric heating sheet of the invention is made of a unidirectionally conductive fabric comprising conductive yarns and insulating yarns, in which at least the surfaces are insulated, as warps and wefts respectively. The conductive yarns are woven so that there are no electric contacts with neighboring conductive yarns, and at least one pair of electrodes is connected to the ends of the conductive yarn to carry electric current and generate heat.

It is preferable that at least one pair of electrodes is connected to ends of the conductive yarn.

It is preferable that the conductive yarns are woven parallel to each other with gaps in between them, and a polymeric insulating layer is formed on both surfaces of the unidirectionally conductive fabric and in the gaps.

It is preferable that the conductive yarn has an insulating covering layer on its surface.

It is also preferable that the conductive yarn is formed by spirally winding a conductive wire on an insulating core yarn.

It is further preferable that the conductive yarn is a twisted yarn of an organic fiber and at least one fine metal wire having a diameter of less than 100 $\mu$m.

It is preferable that the conductive yarn is a polymer fiber having a conductive covering layer, and that the yarn has the function of losing continuity when the conductive covering layer is broken.

It is also preferable that the conductive covering layer is a conductive polymer or a metal of low melting point.

It is preferable that the insulating yarn where at least the surface is insulated is a conductive wire having an insulating covering layer on its surface.

It is also preferable that at least one of the conductive yarn and the conductive wire is used as a heating wire.

In order to achieve the second objective, the electric heating sheet of the invention has an insulating covering layer of thermoplastic polymer which melts by heating, short-circuiting the conductive yarn and the conductive wire, thus functioning as a thermal fuse element.

The electric heating sheet of the third objective of the invention comprises at least two conductive yarns as a pair of electrodes and a thermosensitive layer between the electrodes. This heating sheet detects the change in impedance, due to the temperature change in the thermosensitive layer, by the pair of electrodes.

It is preferable that the thermosensitive layer comprises an electrically thermosensitive polymeric compound, and that the layer melts when overheated, short-circuiting the conductive yarn and the conductive wire at the section where the yarn and the wire cross each other, thus functioning as a thermal fuse element.

The electric heating sheet of the fourth objective of the invention comprises at least two conductive yarns as a pair of electrodes and a resistance layer with a large positive temperature coefficient of resistance between the electrodes.

It is preferable that the resistance layer is made of a polymeric composition including carbon black.

It is also preferable that electrode terminals are connected to the ends of conductive yarns and conductive wires, and that the exposed sections of the conductive yarns and wires are then covered with resin.

Since the conductive yarns of the first electric heating sheet of the invention are not electrically in contact with each other, the heating sheet has the following characteristics:

(a) When an electrode is connected to each end of the conductive yarn, each yarn is connected in a parallel condition to each electrode. In using these conductive yarns as heating wires and applying a constant voltage between the electrodes, when one heating wire locally loses the continuity for mechanical or electrical reasons, the wire simply stops heating and prevents overheating by reducing calorific power at the local sections. The calorific power can be reduced since there is no current leakage from the neighboring sections.

(b) When one heating wire stops heating locally due to damage such as local breakages, the decline in the calorific power of the heating wire is small. Thus, there is little influence on the heating capacity of the heating sheet as a whole, and the sheet can be continuously used while the damage is kept localized.

(c) Even if overheating is generated in the heating sheet by other heat sources or overuse, the heating wire is easily broken through overheating or a small spark, which can cause no serious accidents.

(d) According to these (a)–(c) characteristics of the heating sheet of the first objective of the invention, the heating wire is broken safely without losing the entire heating function of the sheet. Therefore, unlike conventional heating sheets, this heating sheet stops heating only at the damaged local sections while it continuously heats other undamaged sections, thus providing a very durable heating sheet.

In addition to the characteristics (a)–(d) above, the heating sheet of the second objective of the invention has the following additional function:

(e) Even when overheating is generated by an external heat source at a certain section of the heating sheet, the insulating layer made of thermoplastic polymer melts with heat, short-circuiting the conductive yarn and the conductive wire and functioning as a thermal fuse element.

In addition to characteristics (a)–(d), the electric heating sheet of the third objective of the invention has the following additional function:

(f) Since the unidirectionally conductive fabric comprises at least two conductive yarns as a pair of electrodes and a thermosensitive layer between the conductive yarns, the area of the electrode is large and the distance between the electrodes is small. Thus, the impedance of the thermosensitive layer can be easily reduced.

The electric heating sheet of the fourth objective has the following characteristics in addition to characteristics (a)–(d):

(g) The conductive yarns of the unidirectionally conductive fabric of the invention are not electrically in contact with each other, and are arranged in a parallel condition. Therefore, a PTC resistance sheet can be manufactured easily.

(h) Since the conductive yarns are used as the electrodes of the PTC resistance sheet, the distance between the electrodes is narrow so that a heat-diffusion plate is not required.

(i) Since the conductive yarns are used as the electrodes of the PTC resistance sheet, the electrode wires are fine. Therefore, unlike in conventional PTC heating resistors, no heavy current circulates in the electrode wire, and the sheet is safe.

(j) In this heating sheet, the resistance of the conductive yarn is relatively high since the yarn is fine. Therefore, safe serial and parallel heating circuits (series: conductive yarns; parallel: PTC resistance sheets) can be formed.

DETAILED DESCRIPTION OF THE INVENTION

The invention is now explained more specifically by referring to the following examples. The examples are illustrative and should not be construed as limiting the invention in any way.

Figure 1:
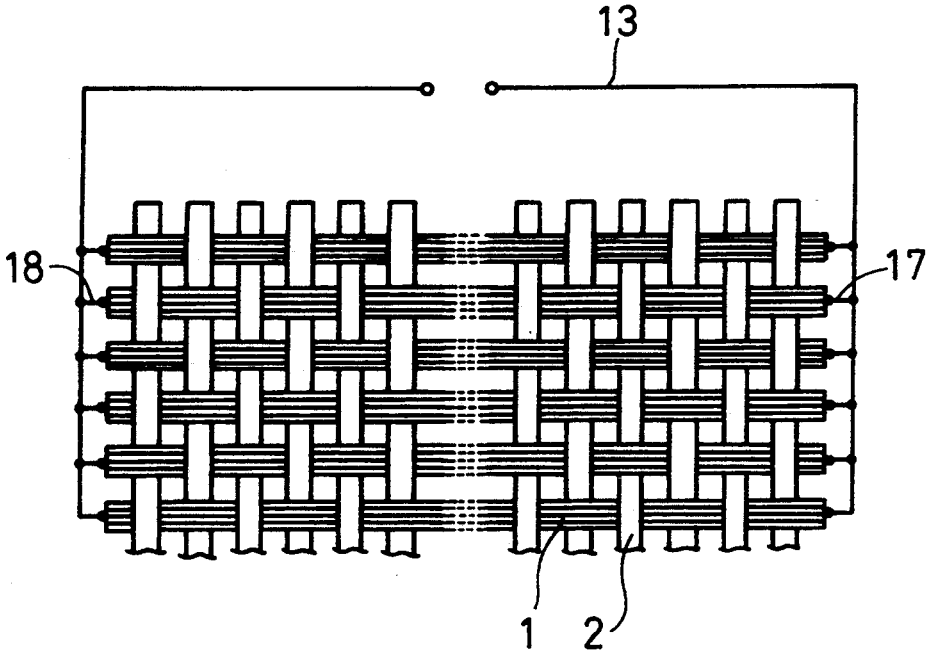
FIG. 1 is a schematic view of an electric heating sheet of a first embodiment of the invention.

As shown in FIG. 1, the first electric heating sheet of the invention comprises conductive yarns 1 and insulating yarns 2 as wefts and warps respectively, thus constituting a unidirectionally conductive fabric. The conductive yarns are not electrically in contact with each other. At least one pair of electrodes 17 and 18 is connected to ends of conductive yarn 1, thus circulating current and providing heat. In this figure, 13 indicates a lead wire.

Figure 3:
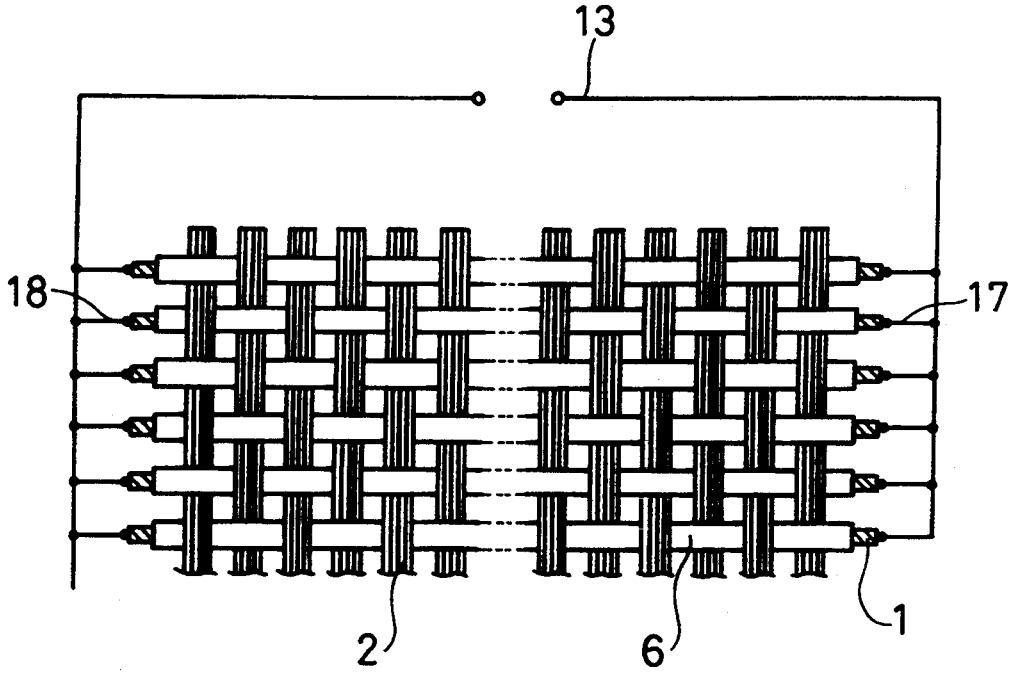
FIG. 3 is a schematic view of an electric heating sheet of another embodiment of the invention.

As shown in FIG. 3, conductive yarn 1 can have an insulating covering layer 6 on its surface. When these conductive yarns are woven to form a highly dense unidirectionally conductive fabric, the yarns are not electrically in contact with each other.

Figure 2:
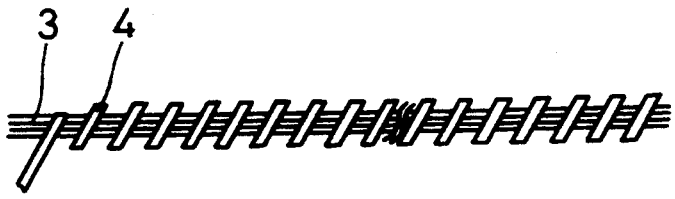
FIG. 2 is a schematic view of a conductive yarn of an embodiment of the invention.
Figure 2:
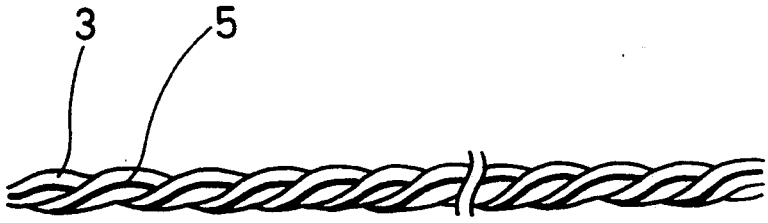

Moreover, conductive yarn 1 of the invention can also be a yarn where a conductive wire 4 is spirally wound around insulating core yarns 3 (FIG. 2(*a*)), or a yarn in which fine metal wires 5 are twisted with insulating core yarns 3 (FIG. 2(*b*)). These conductive yarns have significant strength against bending. The diameter of fine metal wire 5 shown in FIG. 2(*b*) is preferably less than 100 μm.

A polymer fiber coated with a conductive covering layer on the surface can also be used as a conductive yarn. This conductive yarn can lose its continuity after breaking its conductive covering layer due to sparks or heat generated by overheating. Polymeric compounds including conductive particles, conductive polymers, metal platings or the like are used for the conductive covering layer. Among these materials, it is most preferable to use conductive polymers such as polypyrrole, polythiophene and polyaniline, or metals of low melting points.

In addition to organic fibers, it is preferable to use conductive wire 1 coated with insulating covering layer 6 as a yarn having insulating properties at least on its surface.

The organic fibers include synthetic fibers such as polyester, polyethylene, polypropylene, polyvinylalcoholholmal, aramide (aromatic polyamide), aromatic polyester, polyphenylenesulfide, polyimide, polyamide and the like. Chemical fibers including rayon and the like, and natural fibers such as cotton, jute and the like can also be used for the yarn having insulating properties at least on its surface. These fibers can be used alone, mixed, combined or twisted with each other. These fibers can also be combined with conductive fibers, or conductive properties can be added to these fibers in the invention.

The diameter of the conductive yarn or the fiber having insulating properties on its surface is preferably less than several mm. A stretchable fiber or other unique fibers can be used for the conductive yarn to improve texture and bending strength.

A round or foil-like (ribbon-like) metal conductive wire can be used for a unidirectionally conductive fabric. The foil-like (ribbon-like) metal conductive wire is especially useful for a plain weave.

As for weaving unidirectionally conductive fabrics, a simple plain weave is suitable for the invention since the fibers can optionally be woven at a distance from each other. As examples of fabrics woven by the plain weave, mesh fabrics used as screens for screen printing, highly dense fabrics and the like are included. By choosing the weaving method, properties such as the strength against bending, the texture or the like can be improved.

Figure 4:
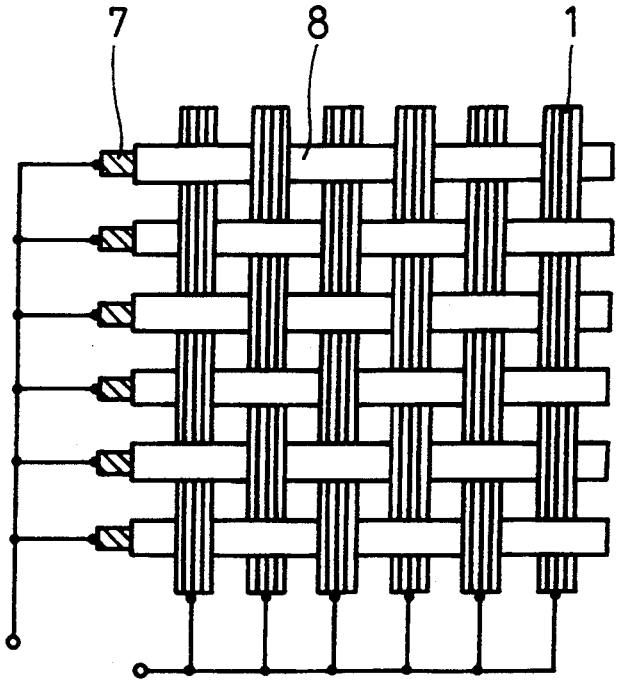
FIG. 4 is a schematic view of an electric heating sheet having a thermal fuse function of an embodiment of the invention.

The second electric heating sheet of the invention includes a conductive wire 7 having an insulating layer of thermoplastic polymer 8 on the surface as shown in FIG. 4. At least one of the conductive yarn 1 and conductive wire 7 is used as a heating wire for generating heat. When insulating layer of thermoplastic polymer 8 melts by overheating, conductive yarn 1 and conductive wire 7 are short-circuited, thus functioning as a thermal fuse element. The same materials and composition as conductive yarn 1 are applicable for conductive wire 7.

Figure 5:
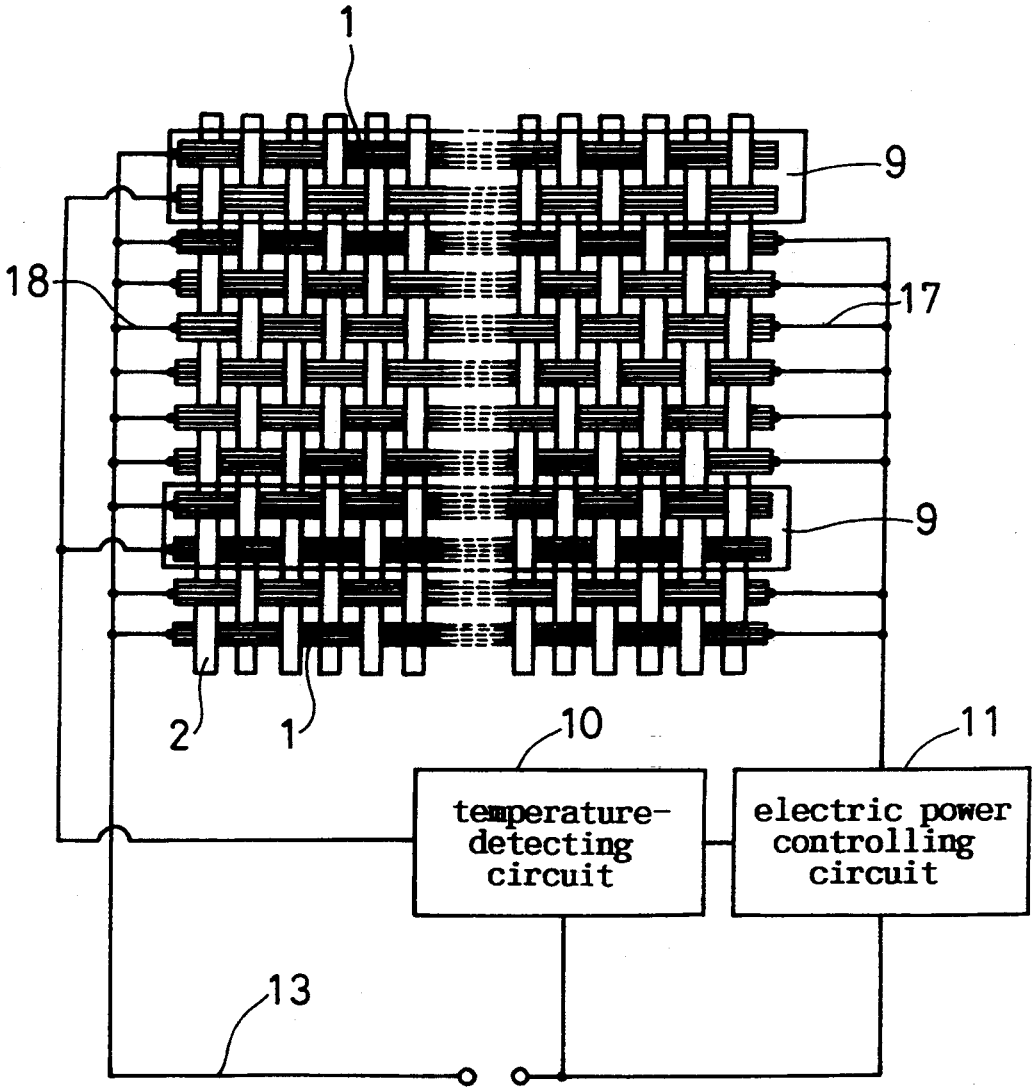
FIG. 5 is a schematic view of an electric heating sheet having a temperature-sensing function of an embodiment of the invention.

As shown in FIG. 5, the third electric heating sheet of the invention comprises at least two conductive yarns 1 as a pair of electrodes and a thermosensitive layer 9 between the electrodes. The changes in impedance due to temperature changes in thermosensitive layer 9 are detected by a pair of electrodes. An electrically thermosensitive polymeric compound with melting properties is preferably used for the thermosensitive layer.

Figure 7:
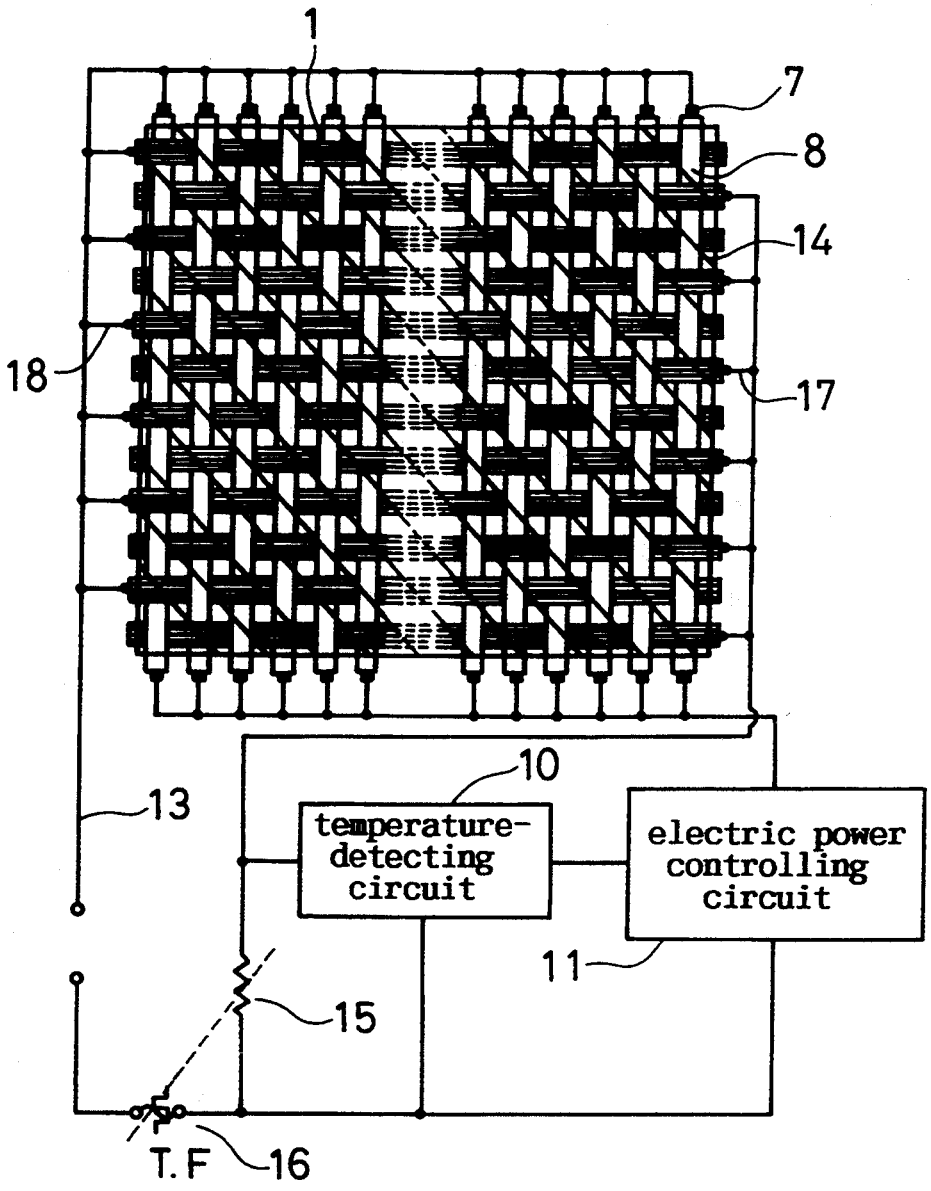
FIG. 7 is a schematic view of an electric heating sheet made of a thermosensitive polymeric compound having a temperature-sensing function and a thermal fuse function and the temperature controlling circuit of an embodiment of the invention.

When the thermosensitive layer comprises an electrically thermosensitive polymeric compound 14 with melting properties, the layer is preferably applied to the electric heating sheet as shown in FIG. 7. Temperature signals in electrically thermosensitive polymeric compound 14 are normally detected by a temperature-detecting circuit 10. Then, by switching on an electric power controlling circuit 11, the electric current for the generation of heat in conductive wire 7 (heating wire) is controlled. When both electrically thermosensitive polymeric compound 14 and insulating layers of thermoplastic polymer 8 melt by local overheating, conductive yarns 1 and conductive wires 7 are short-circuited at the sections where the yarns and wires cross each other, thereby generating heat at a resistance 15 to fuse a temperature fuse 16 thermally connected to the main power supply line.

Figure 8:
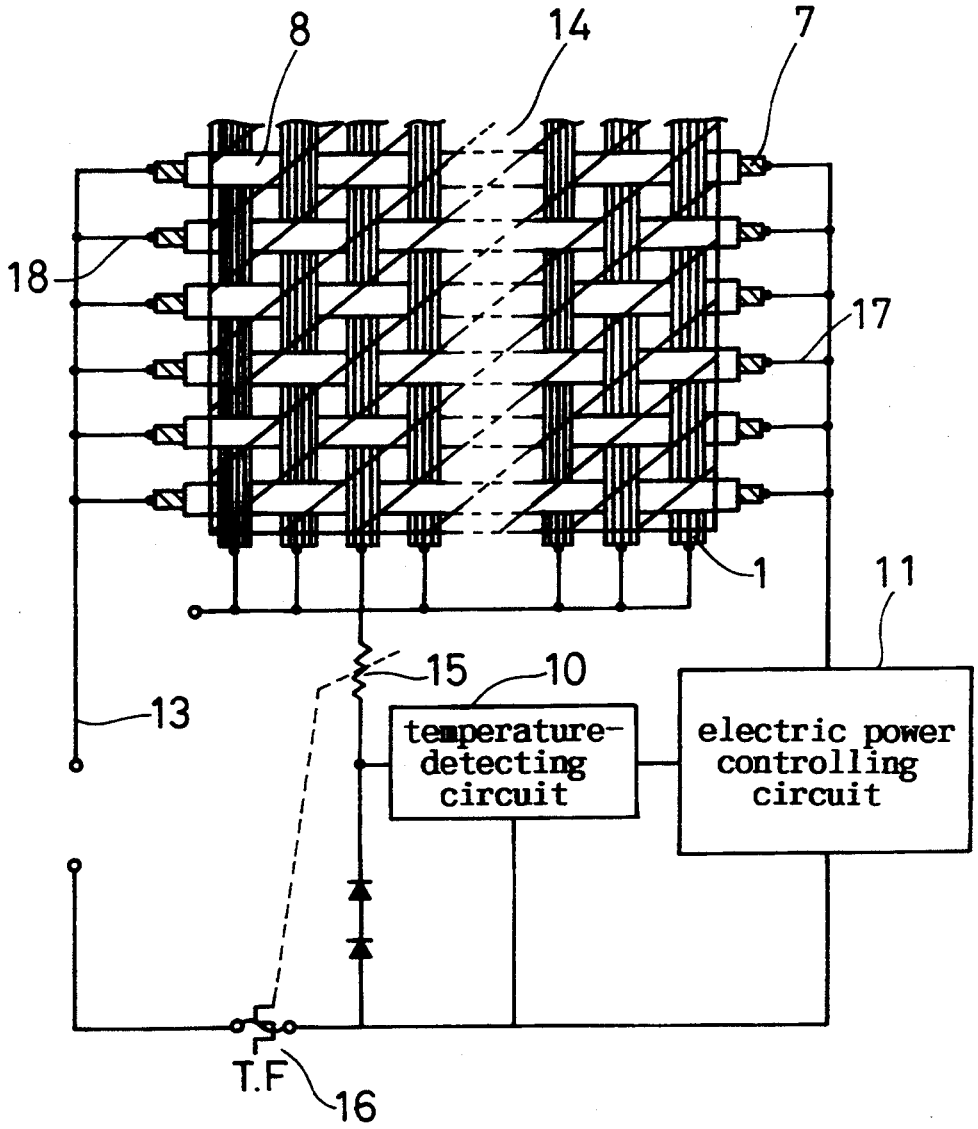
FIG. 8 is a schematic view of an electric heating sheet made of a thermosensitive polymeric compound having a temperature-sensing function and a thermal fuse function and the temperature controlling circuit of another embodiment of the invention.

FIG. 8 shows an electric heating sheet comprising electrically thermosensitive polymeric compound 14 and the temperature controlling device. Conductive wire 7 has an insulating layer of thermoplastic polymer 8 on its surface as shown in FIG. 8. Conductive yarns 1 and conductive wires 7 are woven as warps and wefts respectively to manufacture a unidirectionally conductive fabric. It is preferable to apply an electrically thermosensitive polymeric compound as a material for insulating layer of thermoplastic polymer 8 shown in FIG. 8. In general, the insulating layer of thermoplastic polymer 8 is made of nylon compositions such as nylon 11 and nylon 12, or the like; has insulating properties; and can be used as a thermosensitive compound. In this electric heating sheet, conductive yarns 1 are used as heating wires for generating Joule heat. Temperature signals in electrically thermosensitive polymeric compound 14 are normally detected at temperature-detecting circuit 10, and electric power controlling circuit 11 is then switched on, thus circulating current and generating heat in conductive yarns 1 (heating wires). When electrically thermosensitive polymeric compound 14 is overheated, conductive yarns 1 and conductive wires 7 melt by overheating. The conductive yarns and wires are then short-circuited, thus functioning as a thermal fuse element.

Figure 6:
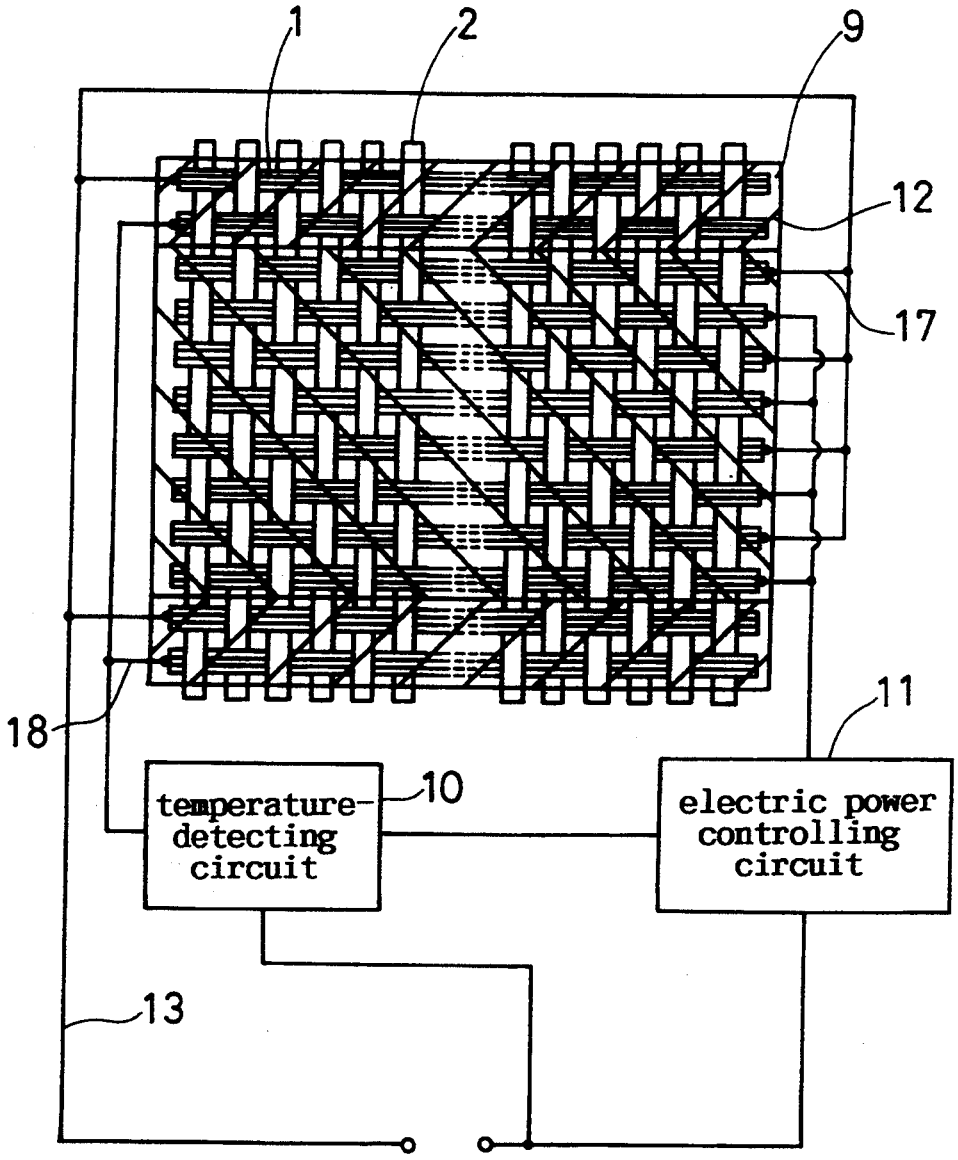
FIG. 6 is a schematic view of an electric heating sheet having a PTC resistance sheet of an embodiment of the invention.

The electric heating sheet of the fourth objective of the invention comprises at least two conductive yarns as a pair of electrodes and a resistance sheet 12 having a large positive temperature coefficient of resistance between the electrodes as shown in FIG. 6. In FIG. 6, thermosensitive layers 9 made of thermosensitive polymeric compounds are applied next to resistance sheet 12. It is preferable to use polymeric compounds including carbon black for the PTC resistance sheet. The changes in impedance due to the temperature changes in thermosensitive layers 9 are detected at temperature-detecting circuit 10 as temperature signals, and electric power controlling circuit 11 is switched on, thus controlling the generation of heat in PTC resistance sheet 12.

In the invention, completely insulating the exposed areas of conductive yarns and wires with resins after connecting electrode terminals to the ends of the conductive yarns and wires is significantly important for improving insulating properties, endurance, bending strength, and humidity-endurance properties of electric heating sheets.

The conductive yards and wires can be woven either as warps or wefts. A thermosensitive sheet (temperature-detecting sheet) can be manufactured in the invention by forming only a thermosensitive layer on a unidirectionally conductive fabric.

EXAMPLE 1

As the first electric heating sheet, conductive yarns 1, made of twisted copper nickel wires of 30 μm diameter, and 1000 denier polyester insulating yarns 2 were plain-woven as wefts and warps respectively as shown in FIG. 1, thus forming a unidirectionally conductive fabric where conductive yarns 1 are not electrically in contact with each other. Pairs of electrodes 17 and 18 were applied to each end of conductive yarn 1, thus manufacturing a heating sheet. Soft polyvinyl chloride sheets were laminated on both surfaces of the heating sheet at 150° C. While electric current was applied from lead wire 13 to the heating sheet in order to heat the sheet, a bending test was carried out on the sheet over a long period of time. There was no sign of local overheating at any broken sections of wires. Thus, the safety of the breaking sections was confirmed by the test.

EXAMPLE 2

The first example of a conductive yarn 1 shown in FIG. 3 was manufactured by coating plasticized polyvinyl chloride insulating covering layer 6 on the surface of twisted copper-nickel alloy wires of 30 μm diameter. Another example of conductive yarn 1 shown in FIG. 2(*a*) was manufactured by spirally winding conductive wire 4, which was a foiled copperaluminum alloy wire 90 μm in diameter, around 1000 denier polyester insulating core yarns 3. The third example of conductive yarn 1 shown in FIG. 2(*b*) was manufactured by twisting fine copper-nickel alloy wires 5 of 60 μm diameter with 1000 denier polyester insulating core yarns 3.

Three unidirectionally conductive fabrics were woven respectively by using these three different kinds of conductive yarns as in Example 1, thus manufacturing three kinds of electric heating sheets. Then, the bending tests were carried out on each heating sheet. It was confirmed by the tests that these heating sheets were safe and had an excellent heating performance.

EXAMPLE 3

A yarn having insulating properties on its surface, which was conductive copper-aluminum alloy wire 7 coated with insulating layer of thermoplastic polymer 8 (made of nylon) as shown in FIG. 4, was used as a weft. Conductive yarn 1 of twisted copper-nickel alloy wires 30 μm in diameter was prepared as a warp. The warps and wefts were plain-woven as shown in FIG. 4, thus producing a unidirectionally conductive fabric where conductive yarns 1 were not electrically in contact with each other. The unidirectionally conductive fabric was used as the second electric heating sheet of the invention; conductive yarn 1 was applied as a heating wire; and conductive wire 7 was used as a signaling wire for fusing when overheated. Electric current was sent to the electric heating sheet, and furthermore the sheet was locally overheated with an iron (external heat source). As a result, insulating layer of thermoplastic polymer 8 melted with the overheating, and conductive yarns 1 and conductive wires 7 then short-circuited, thus functioning as a thermal fuse .element.

EXAMPLE 4

Conductive yarns 1, made of twisted copper-aluminum alloy wires 30 μm in diameter, and 1000 denlet polyester insulating yarns 2 were used as wefts and warps respectively, and were plain-woven as shown in FIG. 5 to form a unidirectionally conductive fabric. Then, two neighboring conductive yarns 1 were used as a pair of electrodes, and thermosensitive layer 9 was formed between the electrodes. Thus, an electric heating sheet which detects the changes in impedance due to temperature changes in thermosensitive layers 9 was manufactured. Thermosensitive layers 9 were made of an ion-conduction type thermosensitive polymeric compound. A temperature control device was applied as shown in FIG. 5, and voltage was applied to the electric heating sheet. When the electric heating sheet was heated normally, temperature signals at thermosensitive layers 9 were detected at a temperature-detecting circuit 10, thus switching on an electric power controlling circuit 11 to control the generation of heat in conductive yarns 1. When the sheet was locally overheated with an external heat source, conductive yarns 1 at the overheated sections lost continuity, thus maintaining the safety of the electric heating sheet.

EXAMPLE 5

A yarn having insulating properties at least on its surface, which was a conductive copper-aluminum alloy wire 7 coated with insulating layer of thermoplastic polymer 8 (made of nylon), was used as a warp. Conductive yarn 1 made of twisted copper-nickel alloy wires 30 μm in diameter was used as a weft. As shown in FIG. 7, the warps and wefts were plain-woven, thus manufacturing a unidirectionally conductive fabric.

A thermosensitive layer of electrically thermosensitive polymeric compound 14 with melting properties (made of nylon) was used. When the heating sheet was heated normally, temperature signals at electrically thermosensitive polymeric compound 14 were detected at a temperature-detecting circuit 10, thus switching on an electric power controlling circuit 11 to control the generation of heat in conductive wires 7. When the heating sheet was locally overheated with an external heat source, both electrically thermosensitive polymeric compound 14 and insulating layer of thermoplastic polymer 8 melted with the heat. Conductive yarns 1 and conductive wires 7 at the sections where the yarns and the wires crossed each other were short-circuited, thus generating heat at resistance 15. As a result, a temperature fuse 16 thermally connected to the main electric source line was fused.

EXAMPLE 6

A yarn having insulating properties at least on its surface, which was conductive wire 7 coated with insulating layer of thermoplastic polymer 8 (made of nylon), was used as a weft. Conductive yarn 1 made of twisted copper-nickel alloy wires 30 μm in diameter was used as a warp. As shown in FIG. 8, the warps and wefts were plain-woven, thus forming a unidirectionally conductive fabric. This unidirectionally conductive fabric was then coated with electrically thermosensitive polymeric compound 14 with melting properties, thus manufacturing an electric heating sheet having a temperature-detecting function. Electric current was flowed into conductive yarns 1 (heating wires), thus generating heat. When the heating sheet was heated normally, temperature signals from electrically thermosensitive polymeric compound 14 were detected at a temperature-detecting circuit 10, thus switching on an electric power controlling circuit 11 to control the generation of heat in conductive yarns 1. When the heating sheet was overheated, electrically thermosensitive polymeric compound 14 melted, thus short-circuiting conductive threads 1 and conductive wires 7 to function as a thermal fuse element.

EXAMPLE 7

Conductive yarn 1, made of twisted copper-aluminum alloy wires 30 μm in diameter, and 1000 denier aromatic polyester insulating yarn 2 were used as a weft and a warp respectively, and were plain-woven as shown in FIG. 6, thus manufacturing a unidirectionally conductive fabric. As the fourth electric heating sheet of the invention, two neighboring conductive yarns 1 were used as a pair of electrodes, and thermosensitive layer 9 was formed between the electrodes. Moreover, resistance sheet 12 having a large positive temperature coefficient of resistance (PTC resistance sheet 12) was formed in the section between thermosensitive layers 9. The thermosensitive layer Was made of an ion-conduction type thermosensitive polymeric compound while the PTC resistance sheet was made of an adhesive cross-linked polyethylene compound including carbon black, thus preparing an electric heating sheet. The electric heating sheet having a temperature controlling device as shown in FIG. 6 was then operated by the application of voltage. When the electric heating sheet was heated normally, changes in impedance due to the temperature changes at thermosensitive layers 9 were detected at temperature-detecting circuit 10. Then, electric power controlling circuit 11 was switched on, thus controlling the generation of heat in PTC resistance sheet 12. Bending tests were carried out on the heating sheet. As for the results, conductive yarns 1 at the damaged sections lost continuity, and the safety of the heating sheet was maintained. There were no sign of burns or the like due to the wire breakages.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, and all changes which come within the meaning and range of equivalency of the claims are intended to be embraced therein.

I claim:

1. An electric heating sheet comprising a unidirectionally conductive fabric in which conductive yarns and conductive wires having an insulating covering layer on their surfaces are woven as warps and wefts, woven such that neighboring conductive yarns are not electrically in contact with each other, and further comprising at least one pair of electrodes, connected to both ends of said conductive yarn to apply an electric field therebetween and generate heat.

2. An electric heating sheet according to claim 1, wherein at least one of the conductive yarn and the conductive wire is used as a heating wire.

3. An electric heating sheet according to claim 1, wherein the insulating covering layer comprises a thermoplastic polymer, arranged so that if the insulating layer of thermoplastic polymer melts by overheating, the conductive yarns and the conductive wires are short-circuited and function as a thermal fuse element.

4. An electric heating sheet comprising a unidirectionally conductive fabric in which conductive yarns and insulating yarns having insulating properties at least on their surfaces are woven as warps and wefts, woven such that neighboring conductive yarns are not electrically in contact with each other;

wherein at least two conductive yarns are used as a pair of electrodes connected to both ends of said conductive yarn to apply an electric field therebetween and generate heat, and wherein a resistance sheet having a large positive temperature coefficient of resistance is formed between said electrodes.

5. An electric heating sheet comprising:

a unidirectionally conductive fabric including conductive yarns and conductive wires having thermoplastic insulating properties at least on their surfaces woven as warps and wefts, woven such that neighboring conductive yarns are not electrically in contact with each other, wherein at least two conductive yarns are used as a pair of electrodes, a thermosensitive layer, formed between the electrodes, changes in impedance due to the temperature changes in said thermosensitive layer being detected by said electrodes, and wherein said pair of electrodes is connected to both ends of said conductive yarn to apply an electric field therebetween which generates heat.

6. An electric heating sheet according to claim 5, wherein the thermosensitive layer is made of an electrically thermosensitive polymeric compound with melting properties, the sheet arranged such that the layer of electrically thermosensitive polymeric compound melts by overheating, thus short-circuiting the conductive yarn and conductive wire across each other in the sheet and functioning as a thermal fuse element.

* * * * *